US005157265A

United States Patent [19]

Uomala

[11] Patent Number: 5,157,265

[45] Date of Patent: Oct. 20, 1992

[54] METHOD FOR DETERMINATION OF THE SIZE AND LOCATION OF AN END HEAD AND THE LOCATION OF AN END HEAD STACK IN A ROLL WRAPPER

[75] Inventor: Vilho O. Uomala, Beaconsfield, Canada

[73] Assignee: Valmet Paper Machinery Inc., Helsinki, Finland

[21] Appl. No.: 423,338

[22] Filed: Oct. 17, 1989

[30] Foreign Application Priority Data

Nov. 1, 1988 [FI] Finland ..... 885042

[51] Int. Cl.[5] ..... G01N 21/86

[52] U.S. Cl. ..... 250/560; 250/561; 356/387

[58] Field of Search ..... 250/223 R, 560, 561; 356/381-387

[56] References Cited

U.S. PATENT DOCUMENTS 4,561,778 12/1985 Kleinhuber ..... 356/387
4,667,093 5/1987 MacDonald ..... 356/386
4,775,236 10/1988 Cohen ..... 356/387

*Primary Examiner*—David C. Nelms
*Assistant Examiner*—Stephone B. Allen

[57] ABSTRACT

This publication discloses a method for the determination of size and location of end heads in a roll wrapper. According to the method, the end head is transferred by means of a pickup arm over photocells and the instants of photocell output signal changes are measured. The distances between the intersect points are determined on the basis of the obtained intersect times and the speed of the end head, and the size and location of the end head are then determined on the basis of the obtained intersect distances and the distance between the photocells. The obtained measurement results are used for controlling the end heading machine.

4 Claims, 1 Drawing Sheet

METHOD FOR DETERMINATION OF THE SIZE AND LOCATION OF AN END HEAD AND THE LOCATION OF AN END HEAD STACK IN A ROLL WRAPPER

BACKGROUND OF THE INVENTION

1. Field of the Invention

The present invention relates to a method in accordance with the preamble of claim 1 for the determination of end head size and location.

2. Description of Related Art

A wide paper roll from the pap machine is transferred to the slitter and slit into rolls of desired width. Next, the rolls are wrapped in the roll wrapper for transportation. In the roll wrapper the roll diameter and width is measured, and on the basis of the measurement results, the width and length of required wrap as well as the diameters of end heads are determined. Wrapping is started by first wrapping the wrap around the roll. The wrap is wider than the roll, allowing the wrap rims to extend over the roll edges. After the wrapping of the wrap around the roll, the inside end heads are inserted to the ends of the paper roll. The inside heads are held in position and the wrap rims are simultaneously crimped over the roll edges. Finally, the outside heads are inserted to the ends of the roll, over the crimped rims of the wrap.

The roll wrappers are automated and the end heads are fetched from the end head stacks by means of suction cup arms. In order to correctly place the heads on the ends of the roll, the stack of end heads must be located in an exactly predetermined place. Conventional end heading stations are provided with a storage rack of end heads having several rotatable shelves. Each shelf contains heads of a different size, and the heads are exactly located on the shelves by means of guides. The machine's control system is provided with information on the size of each head type on any shelf and on the coordinates of the center point of heads in each stack. When the gauging system of the roll wrapper has measured the roll's diameter, it indicates the shelf from which the proper end head is to be fetched, whereby the shelf containing heads of proper size is rotated out from the storage rack of end heads. The suction cup arm then picks up the head at its center and inserts a head onto the roll's end.

The method described above does not provide for the positional measurement of the suction cup arm at the head's center nor for the gauging of the head diameter. Consequently, the method has several disadvantages Because of the lacking positional measurement of the heads' actual location, the stacks of heads must be exactly preplaced to their correct locations, thus necessitating a relatively low height of the head stacks and additionally the use of guides for bracing the stacks. The low-height stacks must be restocked at frequent intervals, which increases the workload of personnel operating the roll wrapper. Furthermore, the system has a low level of controllability and flexibility, since the control system must be provided with prior information on the locations of different size heads and which sizes of heads are available. The system is incapable of detecting incorrect picking of the head or loss of the head prior to its insertion to the end of the roll. Therefore, the machine operation must be continually supervised, and, the machine is incapable of performing a corrective action automatically. Instead the machine requires stopping and guidance back to the step preceding the fault.

OBJECTS AND SUMMARY OF THE INVENTION

The present invention aims to achieve a measurement system, with which the control system of the roll wrapper can detect the size and location of the end head. The system makes it possible to overcome the disadvantages of the conventional methods described above.

The invention is based on transferring the end head over a pair of photocell detectors at a known speed, whereby the size and position of the end head can be determined from the output signals of the photocells.

The invention provides several benefits.

A roll wrapper equipped with a measurement system capable of determining the size and location of the end head has an extremely high degree of flexibility. The end head stacks can be high, and minimal requirements are set for their stacking alignment. The stacks can be placed beside the wrapper onto a convenient platform, from which the pickup arm fetches the proper end head. Since a possibility is available for the determination of the stack's location, the target position indicated for the pickup arm to fetch the end head can be revised on the basis of the measurement result. With the help of the measurement system, the control system of the wrapper can detect heads of incorrect size or heads incorrectly picked which cannot be properly inserted to the end of the roll. At the detection of a defective end head the pickup arm is instructed to take the defective head to a scrap bin. Nevertheless, a defective end head provides information on the location of the head s and head size. The system increases the wrapper's capacity, since the measurement is performed on-line during the normal work cycle of the wrapper. Possible errors can be rectified by the wrapper automatically, which increases the effective work cycle of the wrapper.

The invention is next examined with the help of the attached drawings.

DETAILED DESCRIPTION OF PREFERRED EMBODIMENTS

The determination of the size and position of the end head is performed according to the invention as follows: The end head insertion machine fetches an end head 1 from a stack of end heads at a position indicated by the control system. If the position of the end head stack is different from that indicated by the control system, a pickup arm 4 will deviate from the center point K of the end head 1. The reference point for the pickup arm 4 is determined in the control system. On the basis of information obtained from the tracking sensors, the control system is continually informed on the position of the reference point R. In this example, the reference point R is situated in the plane of the end head 1, on the vertical axis of the pickup arm 4.

Figure 1:
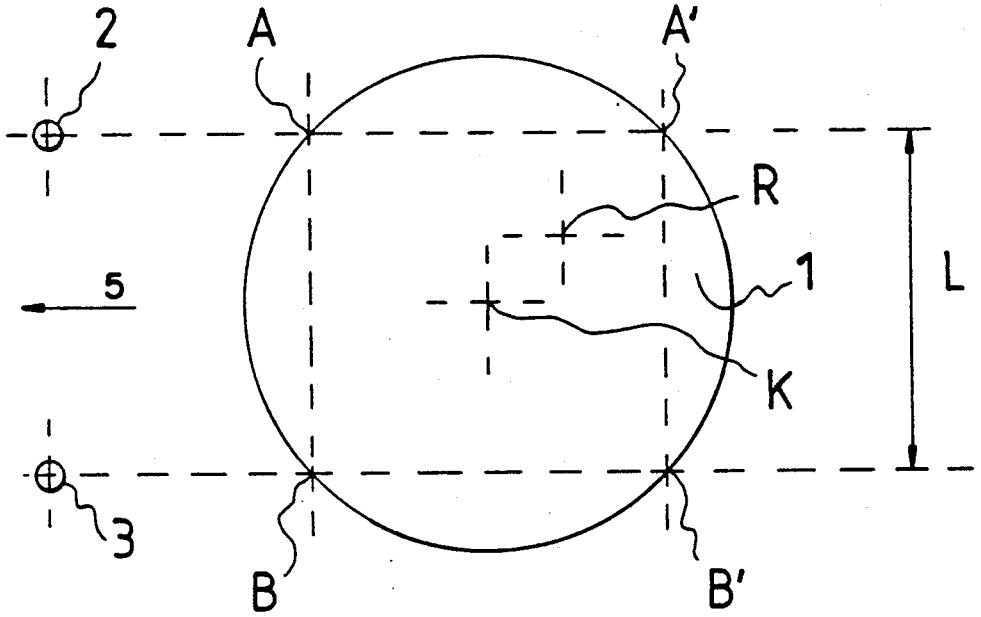
FIG. 1 is a diagrammatic presentation of the operating principle of the invention as seen from above the end head.
Figure 2:
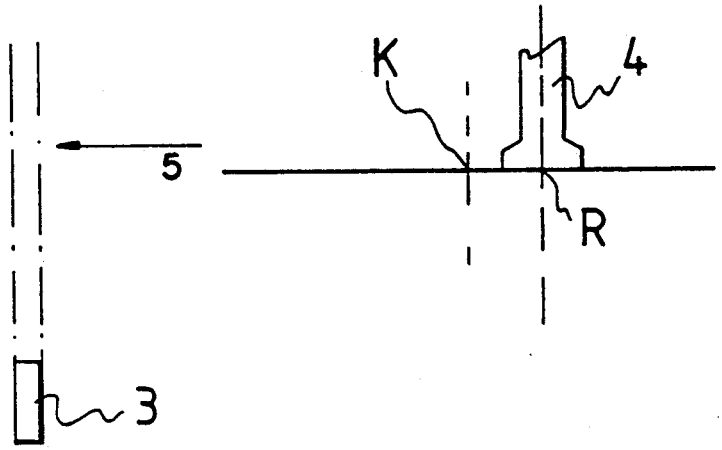
FIG. 2 is a diagrammatic presentation of the operating principle of the invention as seen from the side of the end head.

The trajectory of the pickup arm 4 traverses past photocells 2 and 3. The direction of movement of the end head 1 is marked by arrow 5 in FIGS. 1 and 2. The end head 1 moves at a constant speed past the photocells under the conveyance of the pickup arm 4. When the leading edge of the end head 1 cuts the detecting light beam of photocell 2 or 3 (as marked by points A and B in FIG. 1), the signal sent by the photocell to the control system will change. At the exit of the end head 1 from above the photocells, a new change of signal state will be registered. The instant of signal change will be registered with the help of electronic counter cards. A total of four time instants can thus be determined.

The size and position of the end head 1 can now be determined from the registered time instants The wrapper's control system has information on the distance L between the photocells 2 and 3, the location of the reference point R during the movement of the pickup arm and the speed of the pickup arm 4. The distance between the points A and A' as well as B and B' is computed from the speed of the pickup arm 1 and the time required to traverse the distance between these points. With the distance L between the photocells 2 and 3 being known and preprogrammed in the memory of the control system, a quadrangle A, A', B, B' can be determined. Since the end head shape can be assumed to be circular for all heads, it is obvious that the circumference of the circle passes via the points A, A', B, B'. Further, it is obvious that the center K of the circle is at the intersection of the quadrangle's diagonals.

On the basis of the computational data, the control system can now determine the distance between the center point K of the end head 1 and the reference point R of pickup arm 4. The trajectory of the pickup arm is then corrected by the amount of detected positional error, whereby the head 1 can be inserted in a fully correct position at the end of the roll. The control system also computes the correct location of the end head stack, which with the assumption of a straight stack results in a correct targeting of pickup arm 4 to the center point of the head 1 during the next fetch cycle for the end head.

If the program has incorrect data for the location of a proper size head, the end head 1 of incorrect size is detected in the measurement, allowing the pickup arm 4 to be steered to drop the head 1 into a scrap bin. The corrected information on the size of end heads is stored in the computer memory. After an unsuccessful fetch the program can be continued with a new fetch cycle from another stack, or alternatively, the operation of the end heading machine can be stopped, whereby the control system remains waiting for the operator's instructions.

The system's electronic counter cards are capable of detecting the output signal change of the photocells 2 and 3 at a time resolution of 1 . . . 2 milliseconds. This time resolution is sufficient for attaining a positional resolution of a few millimeters if the transfer speed of the pickup arm is 1 . . . 2 m/s. The attained measurement resolution is sufficient for the detection of different sizes of end heads and controlling their insertion on the ends of the roll.

The method in accordance with the invention is also applicable for the measurement of size and position of planar objects with a noncircular shape. Shapes suitable for the method are, e.g., polygons or other objects with a convex contour, such as ellipses. While the described embodiment has two photocells, their number can be higher. The photocells can also be mounted aligned in other detecting directions than vertical, for instance, horizontal or inclined in a suitable angle relative to the horizontal plane.

Since the equipment used in the method comprises conventional mechanical and electronic components, its detailed description is omitted herein.

What is claimed is:

1. A method for determining the size and location of an end head in a roll wrapper, in which method the location and size of the end head is determined with the help of at least two photocells, comprising the steps of:

measuring the ned had as the end head is transferred by means of a pickup arm at a known speed past at least two photocells placed at a preset spacing from each other;

measuring the instant of output signal change of the photocell when the end head crosses the beam of the photocell;

measuring the instant of output signal change again when the end head has passed the photocell;

transferring the end head in the manner described above past at least one photocell, different from the first photocell, whereby the instants of photocell output signal change are measured in the manner described in the above items;

computing the distances between the intersect points of the end head and photocell beams from the detected instants of output signal change in the known speed of the end head;

computing the size and location of the end head from the distances between the intersect points, known spacing between the photocells, and known shape of the end head; and computing the distance between the computed location of the end head and a reference point of the pickup arm, and on the basis of the obtained positional error, the position of the end head stack is determined and the end head is controlled to be inserted to the correct position on the end of the roll to be wrapped.

2. A method in accordance with claim 1, wherein the end head is transferred at a constant speed past the photocells.

3. A method in accordance with claim 1, wherein the end head is transferred past the photocells so that the end head cuts the beam of the photocells at a 90° angle.

4. A method in accordance with claim 1, wherein the photocells are used in the method that are connected into a bridge configuration.

* * * * *